US008562128B2

(12) United States Patent
Mitsuhashi

(10) Patent No.: US 8,562,128 B2
(45) Date of Patent: Oct. 22, 2013

(54) RECORDING APPARATUS, RECORDING METHOD

(75) Inventor: Masato Mitsuhashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/020,472

(22) Filed: Feb. 3, 2011

(65) Prior Publication Data

US 2011/0205320 A1 Aug. 25, 2011

(30) Foreign Application Priority Data

Feb. 24, 2010 (JP) ..... 2010-039141

(51) Int. Cl.
*B41J 2/01* (2006.01)

(52) U.S. Cl.
USPC ..... 347/102

(58) Field of Classification Search
USPC ..... 347/6, 101, 104, 14, 16, 215; 209/3.2; 399/329; 493/320
IPC ..... B41J 2/01,2/32; G02B 21/00
See application file for complete search history.

(56) References Cited

U.S. PATENT DOCUMENTS

| | | | | |
|---|---|---|---|---|
| 3,023,900 | A * | 3/1962 | Thier | 209/3.2 |
| 5,358,464 | A * | 10/1994 | Funk et al. | 493/320 |
| 5,502,475 | A | 3/1996 | Kaburagi et al. | |
| 7,377,632 | B2 | 5/2008 | Kachi | |
| 2005/0025538 | A1* | 2/2005 | Omata | 399/329 |
| 2006/0119698 | A1* | 6/2006 | Sato | 347/215 |
| 2007/0126832 | A1* | 6/2007 | Kito | 347/101 |
| 2009/0244245 | A1* | 10/2009 | Mitsuhashi et al. | 347/104 |
| 2010/0053238 | A1* | 3/2010 | Suzuki | 347/6 |
| 2011/0242180 | A1* | 10/2011 | Yamamoto | 347/16 |
| 2012/0223994 | A1* | 9/2012 | Yuda et al. | 347/14 |

FOREIGN PATENT DOCUMENTS

| | | | |
|---|---|---|---|
| JP | 02-029340 | A | 1/1990 |
| JP | 05-338136 | A | 12/1993 |
| JP | 2000-177898 | A | 6/2000 |
| JP | 2003-182173 | A | 7/2003 |
| JP | 2003-291382 | * | 10/2003 |
| JP | 2003-291382 | A | 10/2003 |
| JP | 2005-263338 | A | 9/2005 |
| JP | 2005-288905 | A | 10/2005 |
| JP | 2005288905 | A * | 10/2005 |
| JP | 2005338136 | A * | 12/2005 |

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

A recording apparatus includes: an upstream conveying unit that intermittently conveys a recording medium from an upstream side to a downstream side in a conveying direction; a downstream conveying unit that continuously conveys the recording medium; a recording unit that deposits a liquid and performs a recording process on the recording medium while the recording medium is being intermittently conveyed by the upstream conveying unit and has stopped; a fixing unit that performs a fixing process for fixing the liquid on the recording medium being continuously conveyed by the downstream conveying unit after the liquid has been deposited by the recording unit; and a control unit that controls the downstream conveying unit so that the downstream conveying unit conveys the recording medium at a conveying velocity that is higher than an average conveying velocity when the recording medium is conveyed by the upstream conveying unit.

4 Claims, 3 Drawing Sheets

AVERAGE CONVEYING VELOCITY VA

| | | WIDTH W OF PAPER (inches) | |
|---|---|---|---|
| | | WIDE | NARROW |
| RESOLUTION R (dpi) | LARGE | SLOW | — |
| | SMALL | — | FAST |

RECORDING APPARATUS, RECORDING METHOD

CROSS-REFERENCE TO RELATED APPLICATIONS

This application claims priority to Japanese Patent Application No. 2010-039141 filed on Feb. 24, 2010. The entire disclosure of Japanese Patent Application No. 2010-039141 is hereby incorporated herein by reference.

BACKGROUND

1. Technical Field

The present invention relates to a recording apparatus and a recording method in which a liquid is deposited onto a recording medium and the deposited liquid is fixed to perform recording.

2. Related Art

In conventional practice, inkjet printers are widely known as recording apparatuses which perform recording by depositing a liquid onto a recording medium. This type of printer performs printing (image formation) on a paper (recording medium) by ejecting ink (liquid) supplied to an ink ejection head (a recording unit) from nozzles formed on the ink ejection head.

Recently such printers include those in which after the paper is conveyed intermittently and the printing process has been performed, a fixing process is performed and the printed contents are fixed, as disclosed in Japanese Laid-Open Patent Publication No. 2003-291382, for example. Specifically, in this printer, the printing process is performed on the paper by repeating an ink ejection process in which an ink ejection head is moved back and forth in a scanning direction orthogonal to the conveying direction of the paper while the paper has stopped being conveyed, and a paper conveying (intermittent conveying) process while the ejection of ink has been stopped. The paper on which the ink has been deposited is continuously conveyed downstream in the conveying direction and the fixing process is performed.

SUMMARY

However, in a printer which performs the printing process by intermittently conveying the paper and which performs the fixing process by continuous conveying, in cases in which printing is performed by continuously performing printing on a plurality of papers, there is a risk that continuously conveyed papers in front of and behind each other will collide and reduce print quality.

The present invention was devised in view of the problems described above, and an object thereof is to provide a recording apparatus and a recording method whereby collision between recording mediums can be prevented during the process of performing recording on the recording mediums, even in cases in which the conveyed state of the recording mediums has been altered.

To achieve the object described above, the recording apparatus according to a first aspect includes an upstream conveying unit, a downstream conveying unit, a recording unit, a fixing unit and a control unit. The upstream conveying unit is configured to intermittently convey a recording medium from an upstream side to a downstream side in a conveying direction. The downstream conveying unit is configured to continuously convey the recording medium, the downstream conveying unit being provided downstream in the conveying direction from the upstream conveying unit. The recording unit is configured to deposit a liquid and perform a recording process on the recording medium while the recording medium is being intermittently conveyed by the upstream conveying unit and has stopped. The fixing unit is configured to perform a fixing process for fixing the liquid on the recording medium being continuously conveyed by the downstream conveying unit after the liquid has been deposited by the recording unit. The control unit is configured to control the downstream conveying unit so that the downstream conveying unit conveys the recording medium at a conveying velocity that is higher than an average conveying velocity when the recording medium is conveyed by the upstream conveying unit.

According to this configuration, even in cases in which the upstream conveying unit intermittently conveys the recording medium by repeatedly conveying and stopping the recording medium, the recording medium can be conveyed to the downstream conveying unit at a conveying velocity that is higher than the average conveying velocity of the upstream conveying unit. Specifically, a recording medium that already has ink deposited thereon and that is continuously conveyed by the downstream conveying unit is then continuously conveyed so that the gap widens with a recording medium being intermittently conveyed by the upstream conveying unit, and collisions between recording mediums are therefore prevented. Consequently, even in cases in which the conveyed state of the recording medium is altered during the process of performing recording on the recording medium, collisions between recording mediums can be prevented.

In the recording apparatus as described above, the upstream conveying unit preferably varies the stopping time of the recording medium in accordance with the depositing conditions with which the recording unit deposits the liquid on the recording medium, and the control unit preferably controls the downstream conveying unit so that when the stopping time is shorter, the conveying velocity of the downstream conveying unit is higher than when the stopping time is longer.

According to this configuration, the conveying velocity of the downstream conveying unit can be varied so as to correspond with changes in the stopping time during which the upstream conveying unit stops the recording medium. Specifically, the average conveying velocity with which the upstream conveying unit conveys the recording medium can be calculated based on the conveying time and conveying distance with which the recording medium is conveyed, as well as the stopping time during which the recording medium is stopped. Therefore, when the stopping time is short, the average conveying velocity of the recording medium by the upstream conveying unit is higher, but the conveying velocity of the downstream conveying unit is controlled so as to be higher as well. Consequently, collisions between sheets of the recording medium can be prevented even when the conditions of liquid deposits have changed.

In the recording apparatus as described above, the recording unit is preferably a liquid ejection head for depositing the liquid onto the stopped recording medium by ejecting the liquid while moving in a scanning direction orthogonal to the conveying direction, the depositing conditions preferably vary according to the width of the recording medium in the scanning direction, and the control unit preferably increases the conveying velocity to be higher when the recording medium has a large width in the scanning direction than when the recording medium has a small width in the scanning direction.

According to this configuration, the conveying velocity of the downstream conveying unit can be varied according to the width of the recording medium. Specifically, because the liquid is deposited on the recording medium while the liquid ejection device moves in the scanning direction, the distance over which the liquid ejection head moves changes depending on the width of the recording medium. Therefore, since the stopping time can be reduced with a smaller width in the recording medium, the average conveying velocity with which the upstream conveying unit conveys the recording medium is higher. Consequently, even in cases in which the recording medium is small in width and the recording associated with the recording unit has a short stopping time, the conveying velocity by the downstream conveying unit can be increased and collisions between sheets of the recording medium can be prevented.

In the recording apparatus as described above, the depositing conditions preferably vary according to the resolution when the recording unit deposits the liquid on the recording medium, and the control unit preferably controls the driving of the downstream conveying unit so that the conveying velocity is higher when the resolution is low than when the resolution is high.

According to this configuration, the conveying velocity of the downstream conveying unit can be varied according to the resolution when the recording unit deposits the liquid on the recording medium. Specifically, and typically, in cases in which the liquid is deposited on the recording medium, the liquid can be deposited in a shorter amount of time when the resolution is low than when the resolution is high. Therefore, because the stopping time is shorter with lower resolutions, the average conveying velocity with which the upstream conveying unit conveys the recording medium becomes higher. Consequently, even in cases in which the resolution is low and the recording associated with the recording unit has a short stopping time, the conveying velocity by the downstream conveying unit can be increased and collisions between sheets of the recording medium can be prevented.

The recording method according to a second aspect of the present invention includes performing a recording process by depositing liquid on an intermittently conveyed recording medium while the recording medium has stopped; and performing a fixing process by continuously conveying the recording medium, on which the liquid has been deposited in the recording step, at a higher conveying velocity than an average conveying velocity with which the recording medium is conveyed in the performing of the recording process.

According to this configuration, the same operational effects as those of the invention according to the recording apparatus described above can be achieved.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

The first embodiment, in which the recording apparatus and recording method of the present invention are embodied in an inkjet printer, is described below based on the drawings. In the following description, when an "up-down direction" and a "left-right direction" are mentioned, they are referencing the directions shown by the arrows in FIG. 1. When the "forward-backward direction" is mentioned, it is referring to the direction orthogonal to the image plane in FIG. 1, which is also the direction indicated by the arrow in FIG. 2.

Figure 1:
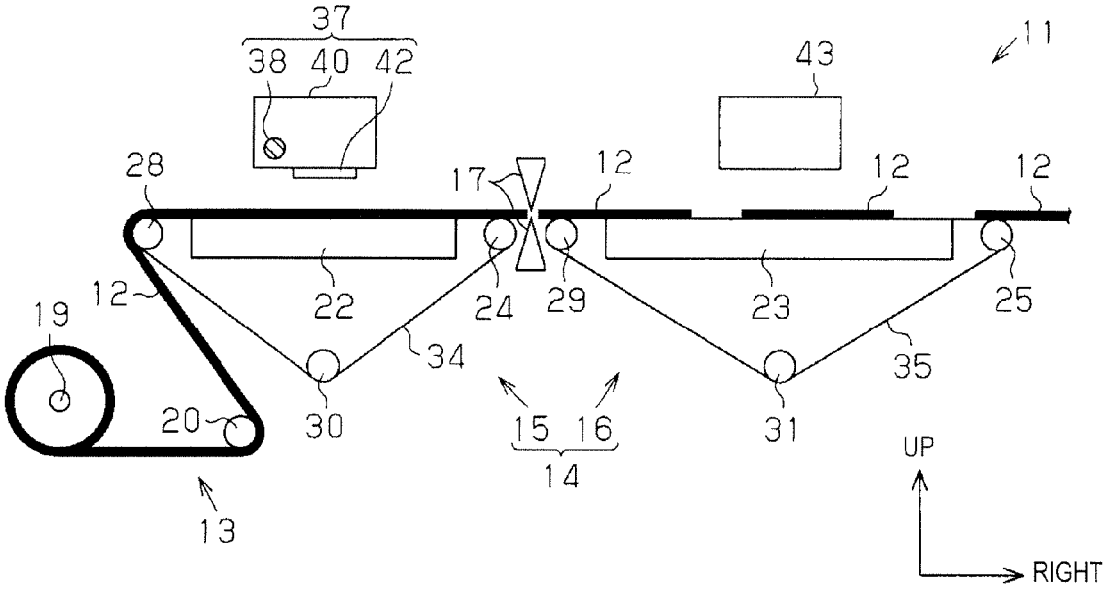
FIG. 1 is a front schematic view of a printer in the first embodiment.

An inkjet printer 11 as a recording apparatus comprises a paper-feeding portion 13 for feeding paper 12 as a recording medium, and a conveying mechanism 14 for conveying the paper 12 fed from the paper-feeding portion 13, as shown in FIG. 1. This conveying mechanism 14 is configured from a first conveying portion 15 which functions as an upstream conveying unit capable of conveying the paper 12 fed from the paper-feeding portion 13 downstream (to the right) in the conveying direction (the left-right direction), and a second conveying portion 16 as a downstream conveying unit. Additionally, between the first conveying portion 15 and the second conveying portion 16 set up downstream in the conveying direction from the first conveying portion 15, a cutter 17 is provided, which is capable of cutting the paper 12 along the left-right direction.

A winding shaft 19 extending in the forward-backward direction is rotatably provided to the paper-feeding portion 13. The paper 12, which is wound into a roll in advance, is supported on the winding shaft 19 so as to be capable of rotating integrally with the winding shaft 19. Additionally, a diverting roller 20 capable of diverting the conveying direction of the paper 12 is provided in a position between the winding shaft 19 and the first conveying portion 15. Specifically, the paper 12 that has been unreeled from the paper-feeding portion 13 along with the rotation of the winding shaft 19 is wound around the diverting roller 20, its conveying direction is converted, and the paper 12 is then conveyed to the first conveying portion 15.

The conveying portions 15, 16 have rectangular plate-shaped first and second platens 22, 23, respectively. To the right of each of the platens 22, 23 are disposed first and second drive rollers 24, 25 that extend in the forward-backward direction and are capable of being rotatably driven by first and second conveying motors 26, 27 (see FIG. 3), respectively. To the left of each of the platens 22, 23, first and second driven rollers 28, 29 extending in the forward-backward direction are rotatably disposed, respectively. Additionally, underneath the platens 22, 23, first and second tension rollers 30, 31 extending in the forward-backward direction are rotatably disposed, respectively.

A first endless conveyor belt 34, in which numerous aeration holes 33 (see FIG. 2) are formed, is wound around the first drive roller 24, the first driven roller 28, and the first tension roller 30 so as to encircle the first platen 22. A second conveyor belt 35 is wound around the second drive roller 25, the second driven roller 29, and the second tension roller 31 so as to encircle the second platen 23. Numerous aeration holes 33 (see FIG. 2) are formed through the second conveyor belt 35, similar to the first conveyor belt 34.

The first and second drive rollers 24, 25 are rotatably driven in the clockwise direction as seen from the front, whereby the conveyor belts 34, 35 are moved in the clockwise direction as seen from the front circumferentially around the exteriors of the drive rollers 24, 25, the tension rollers 30, 31, and the driven rollers 28, 29. The platens 22, 23 are provided with suction means (not shown) capable of suctioning the paper 12 via the aeration holes 33 formed in the conveyor belts 34, 35. As a result, when the paper 12 is in a position facing the top surfaces of the platens 22, 23, the paper 12 is conveyed from the left, which is the upstream side, to the right, which is the downstream side, while being held by suction to the conveyor belts 34, 35.

In a position above the first conveying portion 15, a printing portion 37 is set up as a recording unit for ejecting ink as a liquid and performing printing (recording) on the paper 12 being conveyed by the first conveying portion 15, as shown in FIG. 1.

Figure 2:
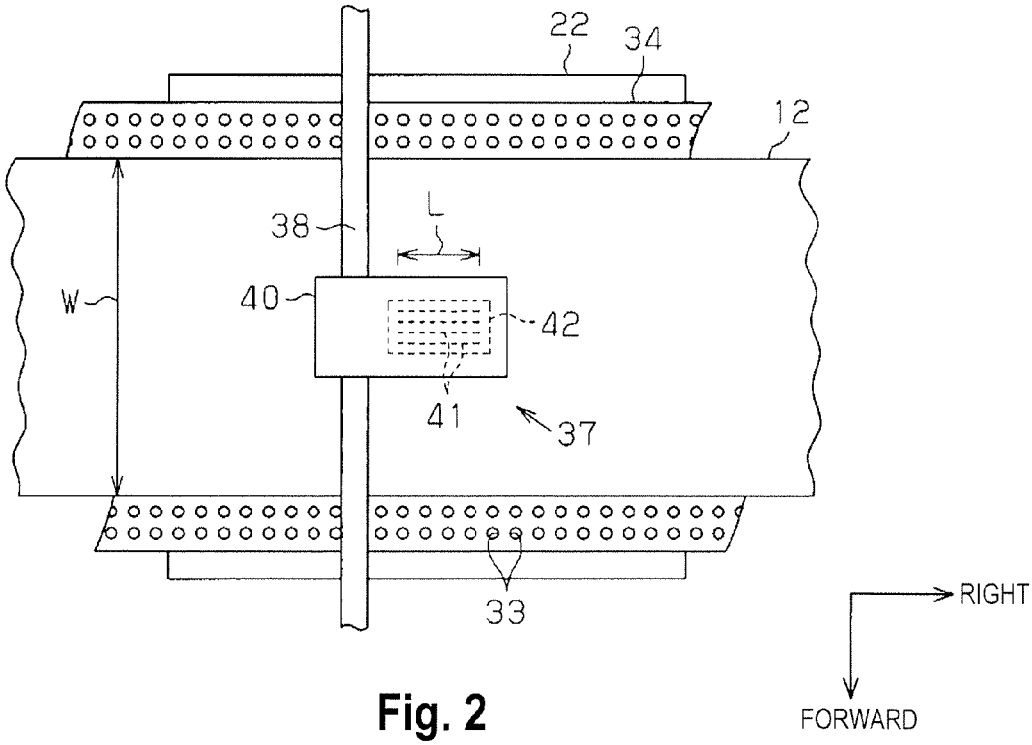
FIG. 2 is a plan schematic view of the printing portion.

The printing portion 37 extends in the width direction (forward-backward direction) of the paper 12 as shown in FIGS. 1 and 2, and has a rod-shaped guide shaft 38 whose front and back ends are supported on a frame (not shown). Supported on the guide shaft 38 is a carriage 40, which can be moved back and forth in a scanning direction (the forward-backward direction) along the guide shaft 38 by the driving of a carriage motor 39 (see FIG. 3). Additionally, the carriage 40 is equipped with a recording head 42 as a liquid ejection head in which at least one (four in the present embodiment) nozzle row 41 is formed extending in the secondary scanning direction (the left-right direction) orthogonal to the scanning direction. The recording head 42 ejects ink supplied from an ink cartridge (not shown) from the nozzles constituting the nozzle rows 41, whereby printing is performed on the paper 12 conveyed by the first conveying portion 15.

In a position above the second conveying portion 16, a heater 43 is provided as a fixing unit capable of heating the paper 12 on which ink has been deposited. The paper 12, having undergone printing when conveyed to the first conveying portion 15, is then conveyed by the second conveying portion 16 where drying is promoted and the printing is fixed, and the paper is then ejected to a paper ejection tray (not shown).

Figures 3, 4:
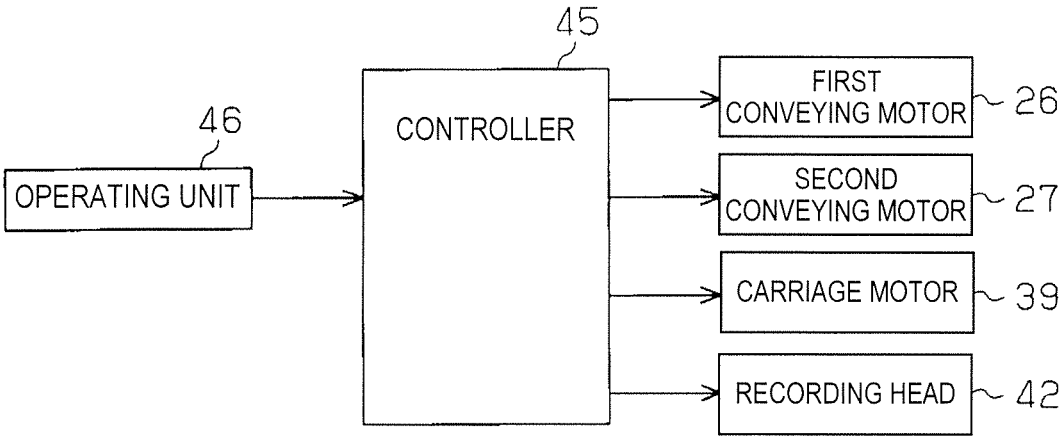
FIG. 3 is a block diagram of the controller.
FIG. 4 is a table for describing the average conveying velocity corresponding to the width of the paper and the resolution.

The printer 11 is provided with a controller 45 as a control unit for collectively controlling the operating states of the printer 11, as shown in FIG. 3. Furthermore, the printer 11 is provided with an operating unit 46 which can be operated by the user to input the width W (see FIG. 2) of the paper 12 in the forward-backward direction and to set the resolution R (see FIG. 4) of the printed image. The controller 45 then sets the conveying velocity V of the paper 12 by the second conveying portion 16 on the basis of the input information from the operating unit 46, and controls the first and second conveying motors 26, 27, the carriage motor 39, and the recording head 42 to perform printing.

In a serial printer 11 which performs printing by causing the carriage 40 and the recording head 42 to scan together, printing is performed by ejecting ink onto paper 12 which has stopped, and the paper 12 is conveyed while ink is not being ejected.

The stopping time, during which the paper 12 is stopped along with one scan of the recording head 42, changes according to the width W of the paper 12, the resolution R, and other printing conditions. Specifically, the controller 45 controls the driving of the carriage motor 39 so as to alter the movement range of the carriage 40 in accordance with the width W of the paper 12. Therefore, when the paper 12 has a large width W, the carriage moves over a greater distance than when the width W is small and more time is required for the movement. Specifically, the greater the width of the paper 12, the more time is required for one scan, and the stopping time of the paper 12 is therefore longer.

The controller 45 controls the driving of the carriage motor 39 so as to alter the movement speed of the carriage 40 in accordance with the resolution R of the printed image. Specifically, when the resolution R is high, ink is ejected while the movement speed of the carriage 40 is slower than cases in which the resolution R is low, whereby ejection of more ink droplets per unit surface area is made possible and printing of a higher resolution R is performed. Therefore, the higher the resolution R, the more time is needed for one scan, and the stopping time of the paper 12 is therefore longer.

When the recording head 42 scans once and one line of printing is performed, the controller 45 then drives the first conveying motor 26 so that the paper 12 is conveyed downstream in the conveying direction by a conveying distance L (see FIG. 2) equivalent to the length of the nozzle rows 41 in the left-right direction. The time from the start until the end of the conveying of the paper 12 is the conveying time required in order to convey the paper 12 by the conveying distance L.

The controller 45 then drives the carriage motor 39 and causes ink to be ejected from the recording head 42 to perform printing on the stopped paper 12. Specifically, the first conveying portion 15 intermittently conveys the paper 12 by alternately and repeatedly conveying and stopping the paper 12, and the printing portion 37 performs the printing process (the recording process) by ejecting ink onto the stopped paper 12.

The average conveying velocity VA of the paper 12 in the first conveying portion 15 is calculated by dividing the conveying distance L by the total of the stopping time plus the conveying time (VA=L/(stopping time+conveying time)).

Therefore, the average conveying velocity VA changes depending on the printing conditions, and becomes slower as the width W of the paper 12 increases and the resolution R increases, as shown in FIG. 4. The smaller the width W of the paper 12 and the lower the resolution R, the higher the average conveying velocity VA.

Figure 5:
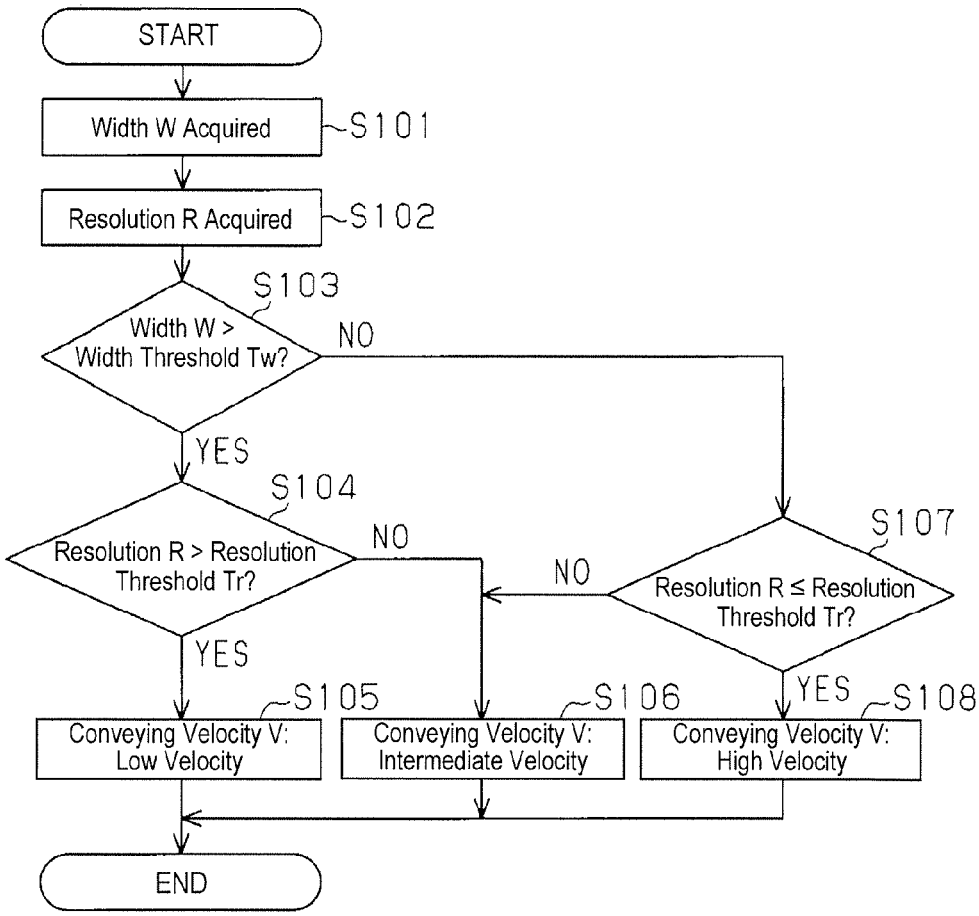
FIG. 5 is a flowchart of the process for varying the conveying velocity.

In view of this, the process whereby the controller 45 sets the conveying velocity V of the second conveying portion 16 is next described based on the flowchart shown in FIG. 5. The width W of the paper 12 and the resolution R are both set in two stages, and the conveying velocity V is set within a velocity range higher than an average conveying velocity VA of the different printing conditions.

First, the controller 45 acquires the width W of the paper 12 (see FIG. 2) set by the operation of the operating unit 46 in step S101, then acquires the resolution R in step S102, and determines the size of the width W of the paper 12 in step S103.

When it is determined that the width W is greater than a width threshold TW (W>TW) (step S103: YES), the controller 45 determines the size of the resolution R in the next step S104. When it has been determined that the resolution R is greater than a resolution threshold TR (R>TR) (step S104: YES), the controller 45 sets the conveying velocity V to a low velocity in the next step S105.

Specifically, when the paper 12 has a large width and a high resolution R, the average conveying velocity VA is lower, and the conveying velocity V is therefore set to a low velocity to match the average conveying velocity VA.

When it is determined in step S104 that the resolution R is equal to or less than the resolution threshold TR (R≤TR) (step S104: NO), in step S106, the controller 45 sets the conveying velocity V to an intermediate velocity which is higher than the low velocity.

When it is determined in step S103 that the width W of the paper 12 is equal to or less than the width threshold TW (W≤TW) (step S103: NO), the controller 45 determines the size of the resolution R in the next step S107. When it has been determined that the resolution R is equal to or less than the resolution threshold TR (R≤TR) (step S107: YES), the controller 45 sets the conveying velocity V to a high velocity in step S108.

Specifically, when the paper 12 has a small width and a low resolution, the average conveying velocity VA is high, and the conveying velocity V is therefore set to a high velocity to match the average conveying velocity VA.

When it has been determined in step S107 that the resolution R is higher than the resolution threshold TR (R>TR) (step S107: NO), the controller 45 sets the conveying velocity V to an intermediate velocity in step S106.

The following is a description of the operations in a case wherein printing is performed in a printer 11 comprising the second conveying portion 16 in which the conveying velocity V has been varied in this manner.

When printing is performed in the printer 11, first, the first conveying motor 26 is intermittently driven in order to intermittently convey the paper 12 fed out from the paper-feeding portion 13 downstream in the conveying direction. The first drive roller 24 is thereupon intermittently driven to rotate based on the intermittent driving of the first conveying motor 26, and the paper 12 is intermittently conveyed at the average conveying velocity VA downstream in the conveying direction in the first conveying portion 15.

The drive states of the carriage motor 39 and the recording head 42 are controlled to match the intermittently conveyed state of the paper 12. Specifically, the respective drive states are controlled so that while the paper 12 has stopped, the carriage 40 moves back and forth in the scanning direction and the recording head 42 ejects ink, and while the paper 12 is moving in the conveying direction, the carriage 40 stops moving back and forth and the recording head 42 also stops ejecting ink. Therefore, printing is performed on the paper 12 by ejecting ink from the recording head 42 onto the paper 12 being intermittently conveyed at the average conveying velocity VA by the first conveying portion 15 (recording step).

Next, the rectangular paper 12, having undergone printing while being intermittently conveyed downstream in the first conveying portion 15, is then cut into single sheets by the cutter 17 when conveyed out of the first conveying portion 15, and afterward conveyed to the second conveying portion 16. The paper 12 cut into single sheets is then conveyed further downstream by the second conveying portion 16, where it is heated by the heater 43 and subjected to the fixing process (fixing step).

At this time, the drive state of the second conveying motor 27, which rotatably drives the second drive roller 25 in order to convey the paper 12 downstream in the conveying direction in the second conveying portion 16, is controlled so that the paper 12 is continuously conveyed at the conveying velocity V set according to the printing conditions (the width W of the paper 12 and the resolution R). Specifically, when the fixing process is performed on the paper 12, if heating conditions in the paper 12 differ in certain parts, there is a risk that it will result in uneven fixing and the print quality will be reduced. Therefore, in the second conveying portion 16, the second conveying motor 27 is driven not intermittently but continuously so that the paper 12 is conveyed continuously. Consequently, it is possible to suppress variation in the heating conditions in the paper 12 by passing the paper underneath the heater 43 while the paper is being continuously conveyed.

The conveying velocity V in the second conveying portion 16 is also set to a high velocity, higher than the average conveying velocity VA in the first conveying portion 15. Therefore, sheets of the single-sheet paper 12 are prevented from colliding with each other, and the paper 12 is conveyed out to the paper-ejecting tray (not shown) so that the gaps gradually become larger between sheets of paper 12 adjacent to each other in the left-right direction.

According to the first embodiment described above, the following effects can be achieved.

(1) Even in cases in which the first conveying portion 15 intermittently conveys the paper 12 by repeatedly conveying and stopping the paper 12, the paper 12 can be conveyed to the second conveying portion 16 at a conveying velocity V that is higher than the average conveying velocity VA of the first conveying portion 15. Specifically, paper 12 that already has ink deposited thereon and that is continuously conveyed by the second conveying portion 16 is then continuously conveyed so that the gap widens with the paper 12 being intermittently conveyed by the first conveying portion 15, and collisions between sheets of paper 12 are therefore prevented. Consequently, even in cases in which the conveyed state of the paper 12 is altered during the process of performing printing on the paper 12, collisions between sheets of paper 12 can be prevented.

(2) The conveying velocity V of the second conveying portion 16 can be varied so as to correspond with changes in the stopping time during which the first conveying portion 15 stops the paper 12. Specifically, the average conveying velocity VA with which the first conveying portion 15 conveys the paper 12 can be calculated based on the conveying time and conveying distance L with which the paper 12 is conveyed, as well as the stopping time during which the paper 12 is stopped. Therefore, when the stopping time is short, the average conveying velocity VA of the paper 12 by the first conveying portion 15 is higher, but the conveying velocity V of the second conveying portion 16 is controlled so as to be higher as well. Consequently, collisions between sheets of paper can be prevented even when the conditions of ink deposits have changed.

(3) The conveying velocity V of the second conveying portion 16 can be varied according to the width W of the paper 12. Specifically, because ink is deposited on the paper 12 while the recording head 42 moves in the scanning direction, the distance over which the recording head 42 moves changes depending on the width W of the paper 12. Therefore, since the stopping time can be reduced with a smaller width W in the paper 12, the average conveying velocity VA with which the first conveying portion 15 conveys the paper 12 is higher. Consequently, even in cases in which the paper 12 is small in width and the printing of the printing portion 37 has a short stopping time, the conveying velocity V by the second conveying portion 16 can be increased and collisions between sheets of paper 12 can be prevented.

(4) The conveying velocity V of the second conveying portion 16 can be varied according to the resolution R when the printing portion 37 deposits the ink on the paper 12. Specifically, and typically, in cases in which the ink is deposited on the paper 12, the ink can be deposited in a shorter amount of time when the resolution R is low than when the resolution R is high. Therefore, since the stopping time is shorter with a lower resolution R, the average conveying velocity VA with which the first conveying portion 15 conveys the paper 12 is higher. Consequently, even in cases in which the resolution R is low and the printing of the printing portion 37 has a short stopping time, the conveying velocity V of the second conveying portion 16 can be increased and collisions between sheets of paper 12 can be prevented.

(5) When the same image is printed, the quantity of ink that can be deposited per unit surface area increases at a higher resolution R, and a greater amount of energy is therefore needed in order to facilitate the drying of the ink and fix the printing. Therefore, when the resolution R is high, the printing can be fixed by slowing the conveying velocity V and thereby increasing the time during which the paper 12 passes through the heater 43.

Second Embodiment

Figure 6:
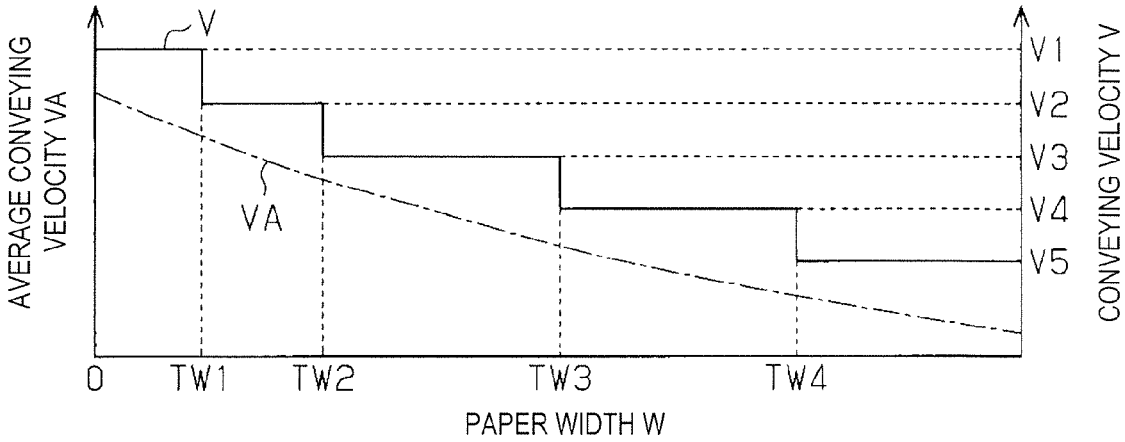
FIG. 6 is a graph showing the paper width and conveying velocity in the second embodiment.

Next, the second embodiment of the present invention is described according to FIG. 6. The second embodiment differs from the first embodiment only in that the method for setting the conveying velocity V in the second conveying portion 16 has been altered, and the configuration of the printer 11 is the same; therefore, identical structural components are denoted by the same symbols and redundant descriptions thereof are omitted.

When printing is performed on multiple types of paper 12 having different widths W as shown by the single-dotted lines in FIG. 6, the average conveying velocity VA decreases as the width W increases. In view of this, in the present embodiment, a case is described in which a plurality of width thresholds TW of the paper 12 are set and the conveying velocity V in the second conveying portion 16 is set at multiple levels.

First, when the width W of the paper 12 is less than a first width threshold TW1 (W<TW1), the conveying velocity V is set to a first conveying velocity V1 that is higher than the average conveying velocity VA when the width W of the paper 12 is at a minimum. Specifically, because the average conveying velocity VA becomes higher as the width W of the paper 12 decreases, the conveying velocity V can be made higher than the average conveying velocity VA by setting the conveying velocity V in accordance with the minimum size of the paper 12.

When the width W of the paper 12 is equal to or greater than a first width threshold TW1 and less than a second width threshold TW2 (TW1≤W<TW2), the conveying velocity is set to a second conveying velocity V2 which is higher than the average conveying velocity VA at the first width threshold TW1. Furthermore, when the width W of the paper 12 is equal to or greater than a second width threshold TW2 and less than a third width threshold TW3 (TW2≤W<TW3), the conveying velocity is set to a third conveying velocity V3 which is higher than the average conveying velocity VA at the second width threshold TW2.

Similarly, when the width W of the paper 12 is equal to or greater than the third width threshold TW3 and less than a fourth width threshold TW4 (TW3≤W<TW4), the conveying velocity is set to a fourth conveying velocity V4 which is higher than the average conveying velocity VA at the third width threshold TW3. When the width W of the paper 12 is equal to or greater than the fourth width threshold TW4 (TW4≤W), the conveying velocity is set to a fifth conveying velocity V5 which is higher than the average conveying velocity VA at the fourth width threshold TW4.

The following is a description of the operations when printing is performed in a printer 11 comprising the second conveying portion 16 in which the conveying velocity V is varied in this manner.

When printing is performed in the printer 11, the first conveying motor 26 is first intermittently driven, whereby the paper 12 is intermittently conveyed downstream in the conveying direction in the first conveying portion 15 at an average conveying velocity VA corresponding to the width W of the paper 12. The carriage motor 39 is also driven so as to change the movement range of the carriage 40 in accordance with the width W of the paper 12, and printing is performed on the paper 12 by ink being ejected from the recording head 42 (recording step).

Next, the rectangular paper 12, which has undergone printing in the first conveying portion 15 while being intermittently conveyed downstream, is then conveyed out of the first conveying portion 15, cut into single sheets by the cutter 17, and conveyed into the second conveying portion 16. Having been cut into single sheets, the paper 12 is continuously conveyed further downstream by the second conveying portion 16 and is heated by the heater 43 to undergo the fixing process (fixing step).

At this time, the drive state of the second conveying motor 27 is controlled so that the paper 12 is continuously conveyed at a conveying velocity V set according to the printing conditions (the width W of the paper 12). Consequently, in the second conveying portion 16, the paper 12 is conveyed at a conveying velocity V that is higher than the average conveying velocity VA in the first conveying portion 15, and the paper 12 is conveyed out to a paper ejection tray (not shown).

According to the second embodiment, the following effects can be achieved in addition to the effects (1) through (5) in the first embodiment.

(6) By varying the conveying velocity V in accordance with the plurality of the width thresholds TW, it is possible to reduce the difference between the conveying velocity V at which the second conveying portion 16 conveys the paper 12 and the average conveying velocity VA at which the first conveying portion 15 conveys the paper 12. Consequently, collisions between sheets of paper 12 can be prevented, the time during which the paper 12 passes through the heater 43 can be increased, and it is therefore possible to perform the fixing process while sufficiently exposing the paper 12 to the heater 43 even when the heater 43 has a small width in the left-right direction. Consequently, this can contribute to the size reduction of the device.

The embodiments described above may be modified as follows.

In the embodiments described above, a plurality of resolution thresholds TR may be provided for the resolution R, and the conveying velocity V may be set to multiple levels corresponding to the resolution R. It is also an option to vary the conveying velocity V according to at least one of either the resolution R or the width W of the paper 12.

In the embodiments described above, the fixing unit for fixing the printing on the paper 12 may be blown air, an increase in pressure, ultraviolet irradiation, or other means. A combination of these fixing unit may also be used.

In the embodiments described above, the position where the cutter 17 is provided can be set as desired as long as it is a position upstream from the heater 43 in the conveying direction. Specifically, the cutter may be provided upstream from the first conveying portion 15, for example, and the printing portion 37 may perform printing on the single-sheet paper 12 being conveyed after being cut. Single-sheet paper 12 may also be fed out from the paper-feeding portion.

In the embodiments described above, a drive source need not be provided to the winding shaft 19, and the paper 12 may be unreeled from the paper-feeding portion 13 by the conveying force of the first conveying portion 15. There is a risk that the paper 12 will tear when pulled suddenly, and when there is a large amount of paper 12 in the paper-feeding portion 13, the paper is preferably pulled more slowly than when there is a small amount. The conveying velocity V in the second conveying portion 16 may be varied according to the average conveying velocity VA which changes due to the conveying time in the first conveying portion 15 being varied in this manner.

In the embodiments described above, a printer other than a serial printer may be used as long as it is a printer which intermittently conveys the paper 12 and performs printing continuously on multiple sheets of paper, or a printer which intermittently conveys rectangular paper, performs printing, and cuts the paper into single sheets. Specifically, the present invention can also be applied to a lateral printer which conducts printing while the carriage 40 is moved in the scanning direction and the secondary scanning direction, or a printer which conducts printing and intermittent conveying on one sheet of paper 12 at a time, such as stain printing, screen printing, or the like, for example.

In the embodiment described above, the recording apparatus was specified as the inkjet printer 11 for ejecting ink to perform recording, but a liquid ejection device that ejects or discharges a liquid other than ink may also be used. The present invention is applicable to various liquid ejection devices comprising liquid ejection heads or the like for discharging droplets in extremely small amounts. The term "droplets" refers to the state of the liquid discharged from the liquid ejection device, and includes those which leave trails of grains, tears, or threads. The liquid referred to herein need only be a substance that can be ejected by the liquid ejection device. For example, the material need only be in the state of a liquid phase, which includes not only fluids such as liquids of high and low viscosity, sols, gels, other inorganic solvents, organic solvents, solutions, liquid resins, and liquid metals (metallic melt); but also liquids as a state of matter, including liquids containing functional materials composed of pigments, metal particles, or the like which are dissolved, dispersed, or mixed in a solvent. Typical examples of the liquids include ink such as the ink described in the embodiments described above, liquid crystal, and the like. The term "ink" used herein includes common water-based ink and oil-based ink, as well as gel ink, hot melt ink, and other various liquid compositions. Specific examples of the liquid ejection device include, for example, liquid ejection devices which eject a liquid containing an electrode material, a coloring material, or the like in the form of a dispersion or a solvent, which is used in the manufacture of liquid crystal displays, EL (electroluminescence) displays, surface-emitting displays, color filters, and the like; liquid ejection devices which eject a biological organic substance used to manufacture biochips; liquid ejection devices which are used as precision pipettes and which eject a liquid as a test sample; stain-printing devices, micro dispensers; and the like. Further options which may be used include liquid ejection devices which eject lubricating oil at pinpoints onto watches, cameras, and other precision instruments; liquid ejection devices for ejecting an ultraviolet curing resin or another transparent resin liquid onto a substrate in order to form a microscopic semispherical lens (optical lens) or the like used in an optical communication element or the like; and liquid ejection devices for ejecting an acid, an alkali, or another etching liquid in order to etch a substrate or the like. The present invention can be applied to any one of these types of liquid ejection devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

an upstream conveying unit configured to intermittently convey a recording medium from an upstream side to a downstream side in a conveying direction;

a downstream conveying unit configured to continuously convey the recording medium while the upstream conveying unit conveying is intermittently conveying the recording medium, the downstream conveying unit being provided downstream in the conveying direction from the upstream conveying unit;

a recording unit configured to deposit a liquid and perform a recording process on the recording medium while the recording medium is being intermittently conveyed by the upstream conveying unit and has stopped;

a fixing unit configured to perform a fixing process for fixing the liquid on the recording medium being continuously conveyed by the downstream conveying unit after the liquid has been deposited by the recording unit;

a cutting unit configured to cut the recording medium, the cutting unit being arranged between the upstream conveying unit and the downstream conveying unit in the conveying direction; and a control unit configured to control the downstream conveying unit so that the downstream conveying unit conveys the recording medium at a conveying velocity that is higher than an average conveying velocity with which the recording medium is conveyed by the upstream conveying unit; wherein the upstream conveying unit varies the stopping time of the recording medium in accordance with the depositing conditions with which the recording unit deposits the liquid on the recording medium, and the control unit controls the downstream conveying unit so that when the stopping time is shorter, the conveying velocity of the downstream conveying unit is higher than when the stopping time is longer.

2. The recording apparatus according to claim 1, wherein the recording unit is a liquid ejection head for depositing the liquid onto the stopped recording medium by ejecting the liquid while moving in a scanning direction orthogonal to the conveying direction, the depositing conditions vary according to the width of the recording medium in the scanning direction, and the control unit increases the conveying velocity to be higher when the recording medium has a large width in the scanning direction than when the recording medium has a small width in the scanning direction.

3. The recording apparatus according to claim 1, wherein the depositing conditions vary according to the resolution when the recording unit deposits the liquid on the recording medium, and the control unit controls the driving of the downstream conveying unit so that the conveying velocity is higher when the resolution is low than when the resolution is high.

4. A recording method comprising:

conveying intermittently a recording medium from an upstream side to a downstream side in a conveying direction by an upstream conveying unit;

conveying the recording medium continuously by a downstream conveying unit while the upstream conveying unit conveys intermittently the recording medium, the downstream conveying unit being provided downstream in the conveying direction from the upstream conveying unit;

performing a recording process by depositing liquid on the recording medium intermittently conveyed by the upstream conveying unit while the recording medium has stopped;

performing a fixing process by continuously conveying the recording medium by the downstream conveying unit, on which the liquid has been deposited in the recording process, at a higher conveying velocity than an average conveying velocity with which the recording medium is conveyed in the performing of the recording process; and performing a cutting process by cutting the recording medium with the liquid deposited thereon before the fixing process by a cutting unit, the cutting unit being arranged between the upstream conveying unit and the downstream conveying unit in the conveying direction; wherein the stopping time of the recording medium conveyed by the upstream conveying unit is varied in accordance with the depositing conditions with which the liquid is deposited on the recording medium by the recording unit, and the downstream conveying unit is controlled by the control unit so that when the stopping time is shorter, the conveying velocity of the downstream conveying unit is higher than when the stopping time is longer.

* * * * *